United States Patent [19]

Wysong

[11] 4,437,451

[45] Mar. 20, 1984

[54] STOVE WITH CATALYTIC COMBUSTOR AND BYPASS

[75] Inventor: Charles F. Wysong, Birmingham, Ala.

[73] Assignee: Atlanta Stove Works, Inc., Atlanta, Ga.

[21] Appl. No.: 293,253

[22] Filed: Aug. 17, 1981

[51] Int. Cl.[3] ..... F24C 1/14

[52] U.S. Cl. ..... 126/77; 126/123; 110/203; 110/214

[58] Field of Search ..... 126/92 R, 285 R, 287, 126/77, 123; 110/203, 210, 214; 422/115, 171, 177, 200

[56] References Cited

U.S. PATENT DOCUMENTS

| | | | |
|---|---|---|---|
| 2,352,057 | 6/1944 | Wingert | 126/287 |
| 2,443,910 | 6/1948 | Higley | 126/287 |
| 2,658,742 | 11/1953 | Suter et al. | 263/3 |
| 2,845,882 | 8/1958 | Bratton | 110/8 |
| 2,862,095 | 11/1958 | Scofield | 219/35 |
| 3,043,245 | 7/1962 | Hebert et al. | 110/8 |
| 3,056,467 | 10/1962 | Ravich | 23/277 |
| 3,428,434 | 2/1969 | Hurko | 23/288 |
| 3,470,354 | 9/1969 | Tilus | 219/393 |
| 3,880,594 | 4/1975 | Shaw | 23/277 |
| 4,054,418 | 10/1977 | Miller et al. | 23/277 |
| 4,113,439 | 9/1978 | Ookubo | 422/177 |
| 4,213,947 | 7/1980 | Fremont et al. | 423/245 |
| 4,280,476 | 7/1981 | Webb | 126/287 |
| 4,319,556 | 3/1982 | Schwartz et al. | 126/289 |
| 4,330,503 | 5/1982 | Allaire et al. | 422/177 |
| 4,345,528 | 8/1982 | Allaire et al. | 110/203 |
| 4,373,507 | 2/1983 | Schwartz et al. | 126/289 |

OTHER PUBLICATIONS

"On the Technical Side," p. 54, *Wood 'n Energy* Magazine Article.

Franklin Industries, Inc., "Concorde Catalytic Wood Stoves and Fireplace Insert" brochure, copyright 1981.

"Concorde Catalytic" stove Installation Manual Excerpts, (4 pages).

"Concorde Catalytic" insert Installation Manual.

*Primary Examiner*—Larry Jones

*Assistant Examiner*—Noah Kamen

*Attorney, Agent, or Firm*—Kilpatrick & Cody

[57] ABSTRACT

A wood burning stove with a catalytic combustor and combustor bypass structure to increase fuel-burning efficiency and safety by reducing creosote emission by the stove and to provide for safe stove operation even if the catalytic combustor becomes blocked, clogged or otherwise obstructed. The single and multiple bypass structures disclosed utilize bypasses located adjacent to the catalytic combustor or combustors to provide for efficient operation with relatively little smoke flow through the bypass during normal operation and with at least partial combustion of smoke which does bypass the combustor. A smoke relief door automatically actuated by opening the fuel loading door to prevent smoke spillage into the room is also disclosed together with alternative means for supplying secondary air to the stove's combustion chamber in the vicinity of the catalytic combustor.

3 Claims, 8 Drawing Figures

STOVE WITH CATALYTIC COMBUSTOR AND BYPASS

BACKGROUND OF THE INVENTION

1. Field of the Invention

This invention relates to a stove, typically used for burning wood, employing a catalytic combustor to improve stove efficiency and reduce emission of gaseous combustion products and a combustor bypass structure and other improvements to a stove utilizing a catalytic combustor.

2. Description of the Prior Art

Utilization of various catalytic converters or catalytic combustors for the purpose of oxidizing and thereby reducing emissions from ovens, stoves, incinerators and similar devices is well known in prior art. So called "air-tight" or "boiler plate" wood burning stoves generally similar to the stove of the present invention are also well known in the prior art, but few such wood burning stoves have been designed for utilization of a catalytic combustor and none of the prior art designs achieve the objects of the present invention.

One prior art wood burning stove utilizes a monolithic ceramic substrate catalytic combustor positioned in a sleeve communicating between the stove combustion chamber and a second chamber which also communicates with the flue. That stove also employs a smoke relief door actuated to open when the fuel loading door is open; however, the smoke relief door is not located for optimum utility as is the analogous structure in the present invention. Additionally, the prior art stoves do not utilize the novel combustor bypass structure of the present invention or the means for supplying secondary air to the combustion chamber in the region of the combustor of the present invention. Similarly, the prior art does not teach other desirable features of the present invention which will be fully described below.

SUMMARY OF THE INVENTION

The stove of the present invention incorporates a conventional monolithic ceramic substrate catalytic combustor with noble metal catalytic coating to increase the stove's efficiency and reduce the quantity of creosote and other combustion products emitted by the stove. The design of the present invention provides for efficient catalytic combustor operation with a "failsafe" combustor bypass structure to permit safe exhaust of gaseous combustion products from the stove and continued safe stove operation in the event the combustor becomes blocked, clogged, or otherwise obstructed, and the design addresses two other requirements of a catalytic combustor stove.

Efficient operation of the monolithic ceramic substrate catalytic combustor of the type utilized in the stove of the present invention requires that the ceramic substrate be a "honey-comb" structure having a plurality of relatively small tubes or passageways upon which the catalyst is deposited. Such a structure may become clogged by foreign matter, thereby restricting or entirely preventing flow of gaseous combustion products through the catalytic combustor, as a result of improper stove operation by utilization of improper fuel materials or the like. Thus, an acceptable stove design for consumer use must incorporate a "failsafe" feature to insure that the stove will continue to operate without spilling smoke into the room in which it is located even if the combustor becomes clogged, blocked or otherwise obstructed.

Additionally, because most smoke and other gaseous products of combustion must pass through the somewhat constricted structure of the catalytic combustor during operation of a stove utilizing such a combustor, such stoves do not "draw" well when the fuel loading door is open, and smoke from the combustion chamber may therefore spill into the room where the stove is installed unless provision to avoid this result is made in the stove design.

Furthermore, the catalytic combustion process which occurs within and in the vicinity of the catalytic combustor is one which utilizes oxygen; however, the mixture of gases, including combustion products, flowing through the catalytic combustor from the combustion chamber frequently contains an insufficient quantity of oxygen for optimum combustion of such gaseous combustion products within the catalytic combustor. Accordingly, it is advantageous to provide a means for supplying secondary air to the combustion chamber in the vicinity of the combustor so the oxygen in such air may combine with combustible gases during the catalytic combustion stage of stove operation.

It is therefore an object of the present invention to provide an improved wood burning stove utilizing a catalytic combustor to achieve greater stove efficiency while reducing the quantity of creosote and other combustion products emitted by the stove, thereby providing for safer stove operation.

It is further the object of the present invention to provide a catalytic combustor bypass structure for use in conjunction with a wood burning stove to insure "failsafe" stove operation even if the combustor becomes blocked, clogged, or otherwise obstructed so that the flow of gases through the combustor is reduced or eliminated.

Another object of the present invention is to provide an improved means for supplying secondary air to the combustion chamber of a wood burning stove.

It is also an object of the present invention to provide an automatically actuated means for preventing the discharge of combustion gases through the fuel loading door of a wood burning stove when such door is opened during operation of the stove to add fuel or for any other reason.

A further object of the present invention is to provide, in a catalytic combustor wood burning stove, a self-cleaning transparent sight glass for inspecting the catalytic combustor during stove operation.

It is further the object of the present invention to provide a highly efficient multiple catalytic combustor and bypass structure which may be safely utilized in association with wood burning stoves.

Other objects of the present invention will be apparent from the following description and claims, particularly when read in conjunction with the accompanying drawings.

DESCRIPTION OF THE PREFERRED EMBODIMENT

Figure 1:
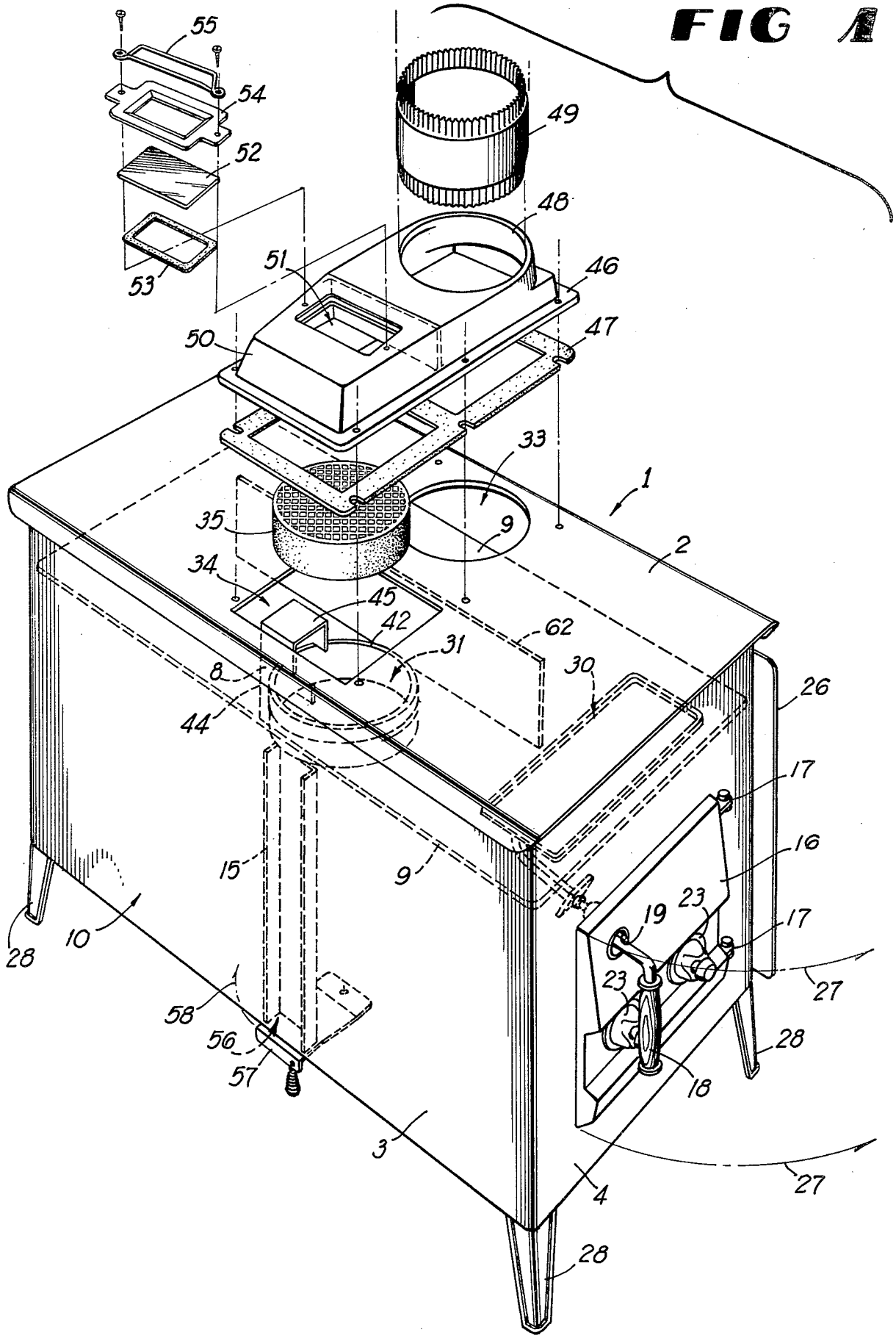
FIG. 1 is a partially exploded perspective view of the stove of the present invention.
Figure 2:
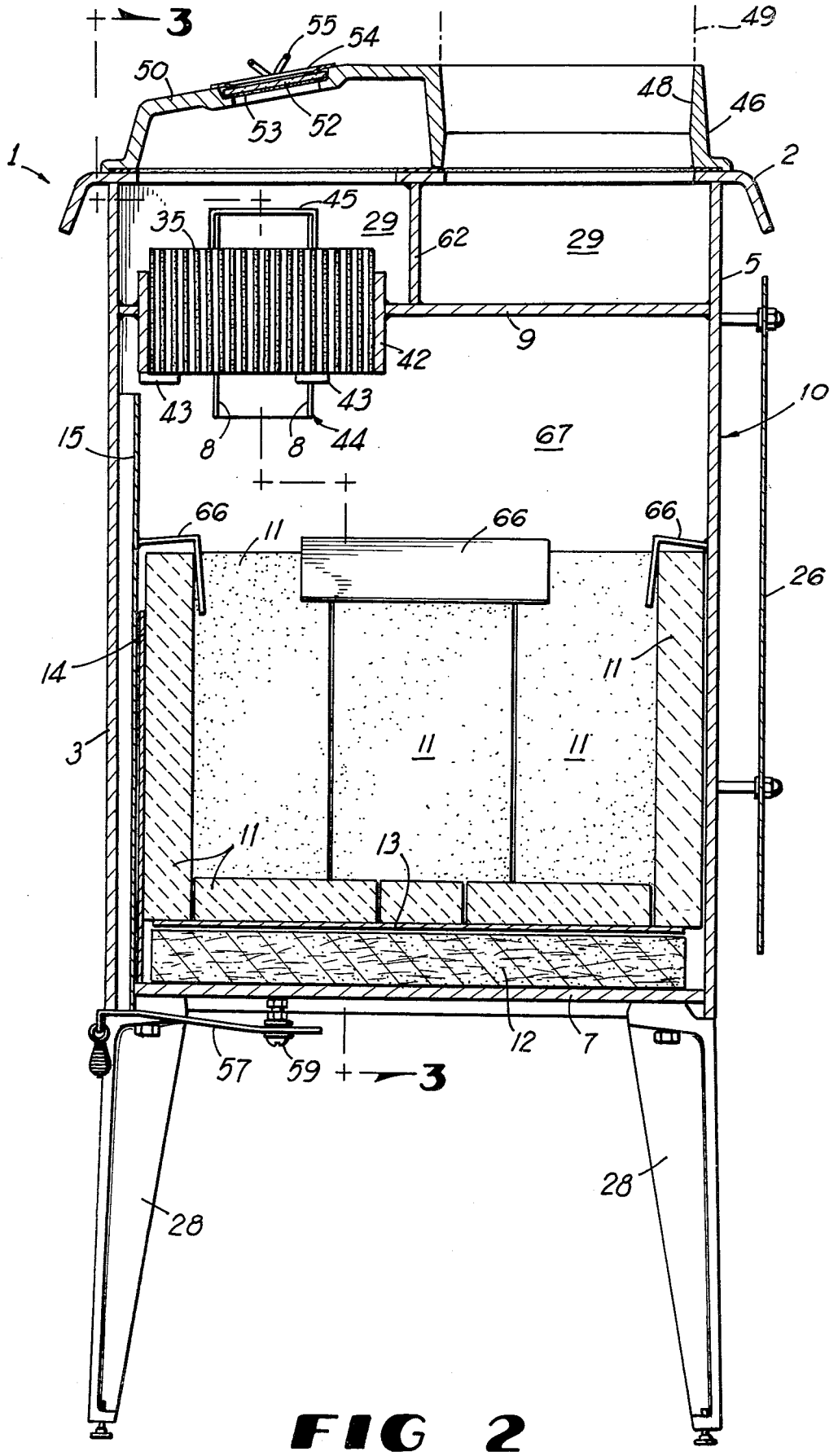
FIG. 2 is a side elevational cross section view through the middle of the stove of the present invention.
Figure 3:
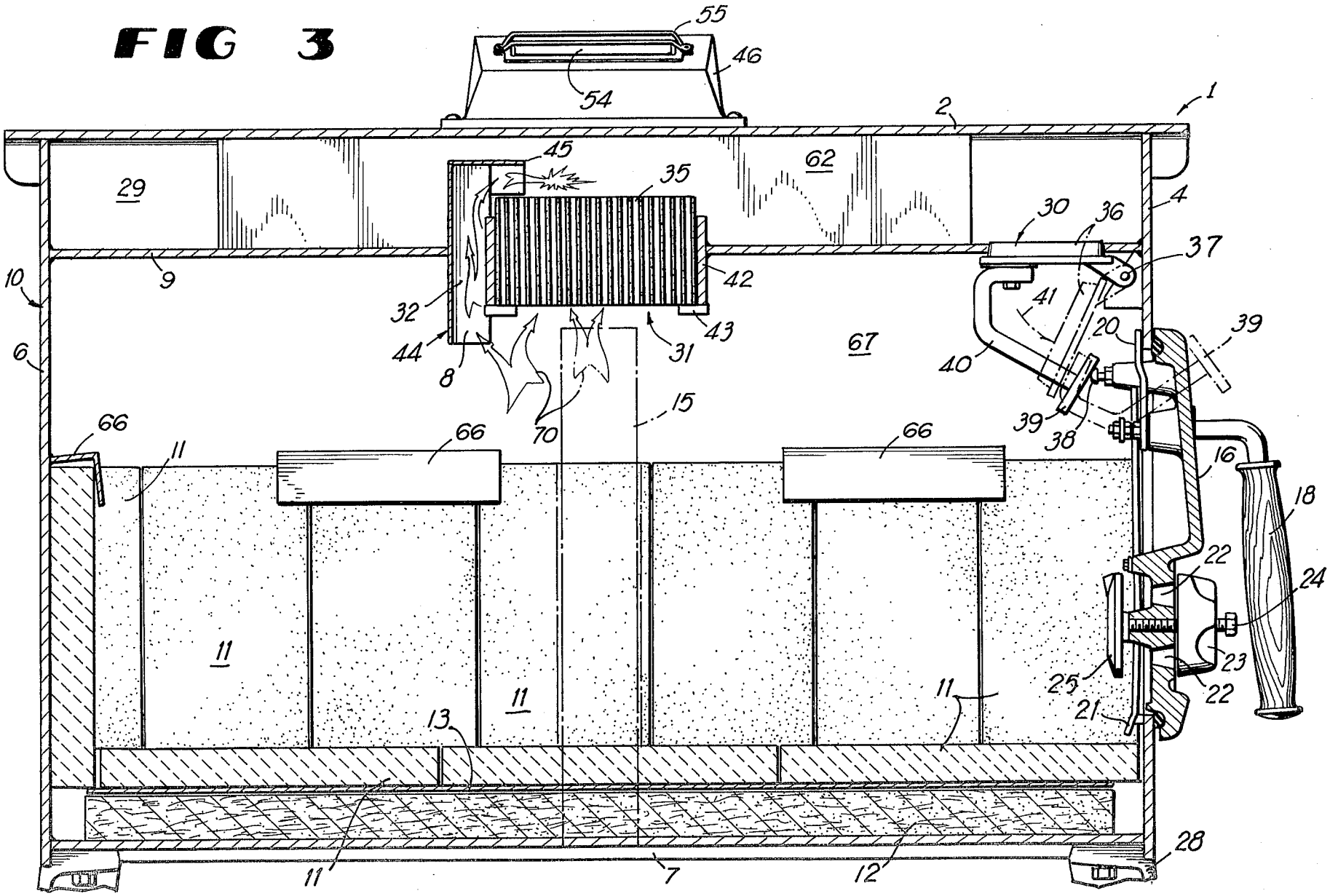
FIG. 3 is an elevational cross section taken along lines 3—3 in FIG. 2.

The stove of the present invention is denoted by numeral 1 in FIGS. 1, 2 and 3 and is comprised generally of a plane vertical front wall 3 parallel to a plane vertical back wall 5, a pair of plane vertical parallel side walls 4 and 6, a horizontal bottom 7 and a top 2. The stove rests on four legs 28.

The front wall 3, back wall 5, side walls 4 and 6 and combustor shelf 9 form a firebox indicated generally by numeral 10 in FIGS. 1, 2 and 3. The fire box 10 is partially lined with firebricks 11 and it forms or contains a combustion chamber identified by numeral 67 in FIGS. 2 and 3. The firebricks 11 are elevated above the bottom 7 of the stove 1 by a batt of bottom insulation 12 and a bottom insulation plate 13, which may be a thin sheet of galvanized or cold rolled steel or other suitable material. The bottom insulation 12, which reduces the quantity of heat radiated from the bottom 7 of the stove 1, may be mineral wool or other suitable material. Bottom insulation plate 13 provides a uniform surface for firebricks 11 to rest on and protects bottom insulation 12 from damage from contact with firebricks 11. The firebricks 11 line the lower portion of front wall 3, side wall 6, and back wall 5 of the stove and are held in place by angle irons 66 (visible in FIGS. 2 and 3) welded or otherwise affixed to the inner side of such stove walls. Referring to FIG. 2, the firebricks 11 lining the inner side of front wall 3 are separated from front wall 3 by side insulation plate 14, which may be a thin sheet of galvanized or cold rolled steel or other suitable material, a secondary air tube 15 and sheets of insulation board (not shown) which are the same thickness as the secondary air tube 15 and substantially fill the spaces between side insulation plate 14 and front wall 3 on either side of secondary air tube 15 to present a substantially uniform surface. Similar to bottom insulation plate 13, side insulation plate 14 protects the insulation (not shown) on either side of secondary air tube 15 from damage by the adjacent firebricks 11.

As is shown in FIG. 1, side wall 4 is fitted with a conventional loading door 16 mounted on conventional hinges 17 so that it may swing open as indicated by arrows 27 to permit loading of wood or other fuel into the stove. The door 16 is manipulated by a handle 18 which is rotatably journaled in an opening 19 in door 16. As is shown in FIG. 3, handle 18 communicates with a conventional latching mechanism which actuates arms 20 and 21 upon rotation of handle 18 to latch loading door 16 closed. Means for providing a primary source of air for supporting combustion in the stove 1 is provided by primary air openings 22 in loading door 16. Openings 22 may be adjustably occluded by conventional draft registers 23 which have threaded holes to receive threaded bolts 24 and which move in and out by rotation on bolts 24 for adjustment of the amount of primary air supplied to the stove 1. Movement of sparks from the firebox 10 through primary air openings 22 is inhibited by draft baffles 25, which partially cover the primary air openings 22.

Stove 1 is additionally provided with a heat shield 26, visible in FIGS. 1 and 2, to reduce radiation of heat from the back wall 5 of stove 1 and thereby permit safe installation of the stove proximate building walls and other structures consistent with recognized minimum safe distances from such walls and other structures.

Again referring to FIGS. 1, 2 and 3, combustor shelf 9, front wall 3, back wall 5, side walls 4 and 6 and top 2 form a heat exchange chamber 29, cross sections of which are visible in FIGS. 2 and 3. Heat exchange chamber 29 communicates with fire box 10 through three openings, cross sections of which are visible in FIG. 3: smoke relief opening 30, catalytic combustor opening 31, and bypass opening 32. Chamber 29 is additionally open for connection to a flue through flue opening 33 in top 2, clearly shown in FIG. 1, and for viewing the catalytic combustor 35, through aperture 34 in top 2, as will be further explained below.

Smoke relief opening 30, which is substantially rectangular in shape in the illustrations but may be of any convenient shape, is closed by a smoke relief door 36 (clearly visible in FIG. 3), which may be made of cast iron or any other suitable material and which pivots on hinges 37 attached to the inside of side wall 4 adjacent to the intersection between side wall 4 and ceiling plate 9. Smoke relief opening 30 and relief door 36 may also be located elsewhere in combustor shelf 9, but location near loading door 16 is desirable to insure that most combustion gases in the vicinity of loading door 16 will pass through smoke relief opening 30 when loading door 16 is opened rather than into the room through the open loading doorway. As may be seen in FIG. 3, smoke relief door 36 is held in its horizontal, closed position when loading door 16 is closed by the pressure of stud 38 bearing against striker plate 39 at the end of arm 40, which projects from smoke relief door 36 as shown in FIG. 3. As is indicated in FIG. 3, when loading door 16 is opened, stud 38 moves toward the outside of the stove causing smoke relief door 36 to swing downward under its own weight, as indicated by arrow 41, to the position indicated by broken lines, thereby leaving unobstructed the relatively large smoke relief opening 30 between combustion chamber 67 and heat exchange chamber 29. Conversely, stud 38, acting on striker plate 39 and arm 40, completely closes smoke relief door 36 on smoke relief opening 30 when loading door 16 is closed.

Combustor opening 31 in combustor shelf 9 is fitted with a sleeve 42 mounted with portions extending above and below shelf 9. Sleeve 42 may be a section of stainless steel pipe or other suitable material able to withstand relatively high temperatures and having an inside diameter slightly larger than the outside diameter of catalytic combustor 35. Typical commercially available combustors are slightly under six inches in diameter; thus, sleeve 42 may conveniently have an inside diameter of six inches (15.3 centimeters). Suitable high temperature, incombustable insulation material (not shown) such as ceramic fiber insulation may be packed between combustor 35 and sleeve 42 to provide a tight fit. Catalytic combustor 35 rests coaxially within sleeve 42 on any suitable projections proximate the bottom of sleeve 42, such as lugs 43 visible in FIGS. 2 and 3. Combustor 35 may be inserted in sleeve 42 from above through aperture 34 in top 2 and may be removed in a similar manner for inspection and/or replacement.

Figure 4:
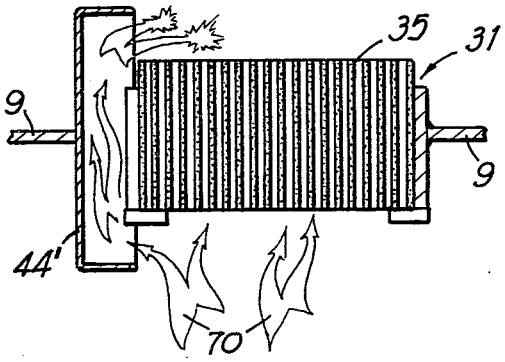
FIG. 4 is a partial elevational cross section similar to FIG. 3 showing an alternative embodiment of the combustor bypass structure of the present invention and the associated catalytic combustor and combustor holding structure.

Bypass opening 32 in combustor shelf 9 is fitted with a bypass such as bypass 44 as shown in FIGS. 1, 2 and 3, or the alternative embodiment of such structure shown as bypass 44' in FIG. 4. Bypass 44 may be fabricated of sheet stainless steel in the form of a rectangular box having one side open, which box is disposed with the edges of the vertical sides 8 adjacent the opening resting against the outside surface of sleeve 42 and is of sufficient height to extend above and below sleeve 42 such that a passage communicating between the combustion chamber 67 and the heat exchange chamber 29 is formed through portions of the open side of the box not closed by the sleeve. Bypass structure 44 also has an optional hood 45, comprising an inverted U-shaped sheet metal member which extends from the upper open portion of bypass structure 44 over a portion of the top of catalytic combustor 35 as may be seen in FIGS. 1 and 3. Hood 45 tends to communicate the relatively high gaseous pressure experienced in the region immediately above combustor 35 during stove 1 operation to the upper end of bypass 44, thereby inhibiting the flow of combustion products into and through bypass 44 from combustion chamber 67. Accordingly, during normal operation, significantly less smoke and other combustion products flow through bypass 44 with hood 45 than would flow through a similar bypass without hood 45 such as bypass 44', shown in FIG. 4. Although hood 45 improves stove operation as described above, it is not required and is therefore shown omitted from bypass 44' in FIG. 4.

In the embodiment of the present invention illustrated in the figures, stove 1 is additionally fitted with a turret 46, which may be manufactured of cast iron. Turret 46 is mounted on the top 2 of stove 1 with a gasket 47 therebetween such that it fits over aperture 34 and flue opening 33 in the manner illustrated in FIGS. 1 and 2. Turret 46 forms a circular collar 48 immediately above flue opening 33 in top 2. Collar 48 is adapted to receive a flue connector 49 as illustrated in FIG. 1 or may receive conventional flue pipe directly.

Turret 46 also forms a sight glass platform 50 defining a surface spaced above aperture 34. Platform 50 is pierced directly above aperture 34 by a sight glass opening 51, which opening is covered by a sight glass 52 resting on a sight glass gasket 53 and protected and held in place by a frame 54 and guard 55. Thus sight glass opening 51 is in registration with aperture 34 and combustor 35.

In the embodiment of the present invention illustrated in FIGS. 1, 2 and 3, a secondary air tube 15 communicates between the outside and inside of the firebox 10 and an area of combustion chamber 67 near combustor 35 by registering with a secondary air opening 56 in the bottom 7 of stove 1. Secondary air tube 15 may be constructed by welding a U-shaped metal channel to the inside surface of front wall 3 of the stove in registration with air opening 56. Secondary air opening 56 is variably obstructed by a secondary air adjustment slide 57, which may be constructed of relatively springy sheet metal. Air adjustment slide 57 pivots as is indicated by arrow 58 in FIG. 1 on a screw 59 or other similar pivot point so that secondary air opening 56 may be variably obstructed during operation of stove 1 to control the quantity of secondary air admitted to the stove.

Figure 6:
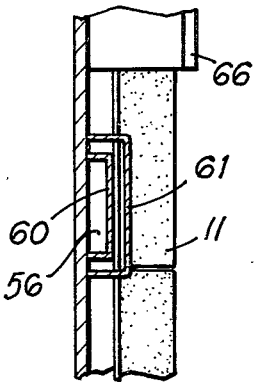
FIG. 6 is a cross sectional view taken along lines 6—6 in FIG. 5.
Figure 5:
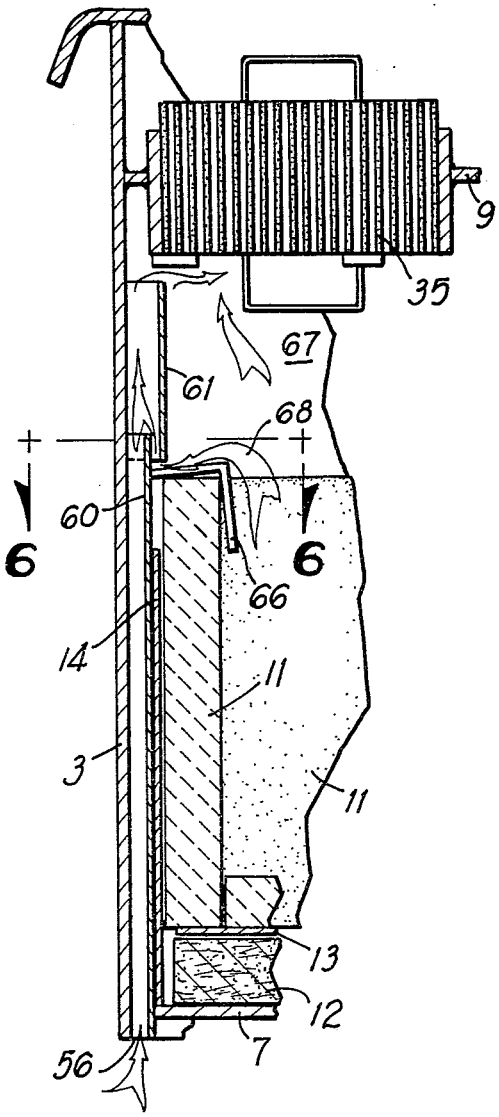
FIG. 5 is a partial side elevational cross section of the stove of the present invention similar to FIG. 2 showing an alternative embodiment of the secondary air supply means of the stove of the present invention.

An alternative embodiment of the means of the present invention for supplying secondary air to the combustion chamber 67 near combustor 35 is illustrated in FIGS. 5 and 6, comprising a secondary air tube first section 60 communicating between secondary air opening 56 and the combustion chamber 67 and secondary air tube second section 61 which, as may be seen in FIG. 6, is a larger tube disposed above and around the upper end of secondary air tube first section 60.

Figure 7:
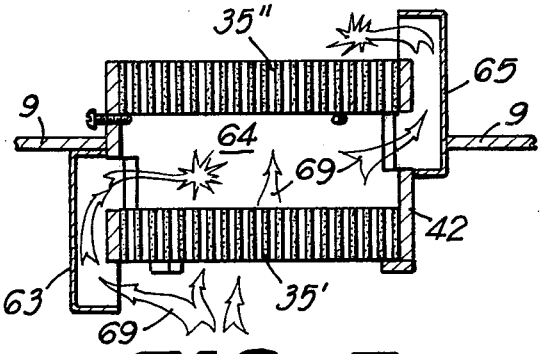
FIG. 7 is a partial elevational cross section similar to FIG. 3 showing a second alternative embodiment of the bypass structure and catalytic combustor and combustor holding structure of the present invention.
Figure 8:
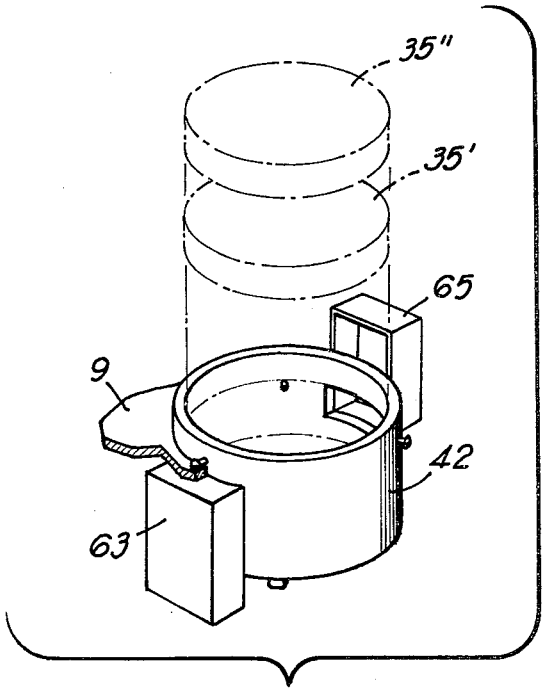
FIG. 8 is an exploded perspective view of the alternative bypass and combustor structure shown in FIG. 7 with the catalytic combustors shown in dotted lines.

An alternative embodiment of the combustor bypass of the present invention is illustrated in FIGS. 7 and 8, which show a dual section or stacked combustor and dual bypass structure. As will be seen by reference to FIGS. 7 and 8, this alternative combustor and combustor bypass structure utilizes two separate catalytic combustors 35' and 35'', each of which is typically of thinner section than combustor 35 illustrated in the other figures. Combustors 35'' and 35' are coaxially disposed in the upper and lower ends of sleeve 42, thereby defining a combustor chamber 64 within sleeve 42 and between combustors 35' and 35''. A first or lower bypass structure 63 forms a passage communicating between the area below the lower combustor 35' and the combustor chamber 64 between the combustors 35' and 35''. A second or upper bypass structure 65 communicates between combustor chamber 64 and the area above the upper combustor 35''. Thus, as indicated by the flow arrows 69 in FIG. 7, smoke and other combustion products pass through lower combustor 35' into combustor chamber 64 and thence through upper combustor 35''. Additionally, such smoke and combustion products can pass through lower bypass structure 63 into combustor chamber 64 and from combustor chamber 64 through upper bypass structure 65 into the area above the upper combustor 35'', thereby establishing a passage for smoke to escape from the firebox even if one or both combustors 35' and 35'' are blocked, clogged, or otherwise obstructed. However, the labyrinth-like structure of the dual section combustor and dual bypass illustrated in FIGS. 7 and 8 ensures that, during normal combustor operation, substantially all smoke and other combustion products are likely to pass through at least one of the combustors 35' or 35'' and all such smoke must pass through combustor chamber 64 where high temperatures are reached as a result of catalytic combustion of smoke within and in the vicinity of combustors 35' and 35''. The double bypass structure of FIGS. 7 and 8 thus establishes combustor chamber 64 as a small "furnace" or chamber in which oxygen may be more evenly distributed with the products of combustion in order to burn more effectively and completely in second combustor 35'' to facilitate complete combustion of smoke and other combustion products while ensuring fail-safe operation of the stove in contemplation of the possibility that one or both of combustors 35' and 35'' may become clogged, blocked or otherwise obstructed.

As will be readily appreciated by one skilled in the art, the multiple-combustor and combustor bypass structure illustrated in FIGS. 7 and 8 may be constructed with any number of combustors desired so long as at least one bypass structure communicating between the regions just above and below each such combustor is provided. It will be similarly appreciated by those skilled in the art that the combustor and bypass structures illustrated and described herein may advantageously be employed in a variety of stove configurations in addition to the embodiment illustrated herein.

Operation of the stove of the present invention is as follows: A conventional fire is built in the firebox 10 utilizing kindling and logs or other combustable materials compatible with the catalyst used on the combustor 35. Access to firebox 10 is available by opening loading door 16. Spillage of smoke into the room where stove 1 is installed when loading door 16 has been opened during operation of stove 1 for the purpose of adding fuel or otherwise is minimized because smoke relief door 36 falls open when loading door 16 is open, as is described above, thereby providing a large, unobstructed passage to the flue or chimney through combustor shelf 9 via smoke relief opening 30. Such spillage would typically occur when loading door 16 is open absent provision for smoke relief such as relief opening 30 because the combustor 35 and bypass 44 provide a relatively constricted smoke passage which will not accommodate all smoke present in combustion chamber 67 when loading door 16 is open. Substantially all smoke and combustion products thus exit the firebox 10 during periods when loading door 16 is open through smoke relief opening 30, bypass 44, and catalytic combustor 35 disposed in combustor opening 31. Location of smoke relief opening 30 near loading door 16 is advantageous in that smoke in the vicinity of loading door 16 is easily diverted through relief opening 30 when loading door 16 is opened.

During normal operation of the stove 1 with loading door 16 closed, primary air is supplied to support combustion of fuel in combustion chamber 67 through primary air openings 22 in loading door 16. During such operation, most smoke and other products of combustion pass through catalytic combustor 35, which comprises a honeycomb-like ceramic substrate forming numerous vertical tubes on the walls of which one or more precious metals or oxides of such metals have been deposited. Catalytic action on the gaseous products of combustion passing through catalytic combustor 35 reduces the temperature at which such gaseous combustion products will burn, thereby resulting in oxidation of such combustion products within and directly above catalytic combustor 35. Sight glass 52 in platform 50 of turret 46 is provided to permit visual inspection of catalytic combustor 35 to observe the red glow within combustor 35 during certain phases of stove operation when temperatures within the combustor reach the incandescent range and to permit visual confirmation that the combustor 35 is not blocked or clogged. Location of sight glass 52 within turret 46 above the level of stove top 2 and therefore out of the main flow of combustion products from the area of combustor 35 around heat exchange chamber baffle 62 and up the flue through flue opening 33 results in minimal deposition of soot or other obscuring material on the underside of sight glass 52. Because sight glass 52 is located directly above and relatively close to combustor 35, any such soot which may be deposited on sight glass 52 during operation of the stove 1 is typically burned off during phases of operation of the stove 1 when high temperatures are reached within and in the vicinity of combustor 35.

In the event that combustor 35 is partially or completely blocked or otherwise obstructed or clogged, bypass structure 44 insures safe operation of stove 1 by providing a passage for combustion products around combustor 35. Bypass 44 is located with openings directly adjacent to the top and bottom of combustor 35 so that combustion products indicated by flow arrows 70 in FIGS. 3 and 4 which pass through bypass 44 during normal operation of stove 1 with a properly functioning combustor 35 will exit bypass 44 near the area where gases passing through combustor 35 exit the combustor. The temperatures produced in the area just above combustor 35 are normally relatively high; thus, combustion products which pass through bypass 44, although not exposed to the catalyst deposited on combustor 35, are nevertheless substantially combusted when such combustion products exit the bypass 44. Optional bypass hood 45 shown in FIGS. 1, 2 and 3 is provided to further direct combustion products passing through bypass 44 to flow over the top of combustor 35 and to facilitate communication of the relatively high or "positive" gaseous pressure present just above the combustor 35 to the bypass 44 as is described above, thereby inhibiting the flow of combustion products from the combustion chamber 67 through bypass 44. Such "positive" pressure is produced as the gases passing through combustor 35 heat up and expand. However, the present invention may also be achieved, as shown in FIG. 4, without utilization of a bypass hood by any suitable structure providing a passage for combustion products having one opening in combustion chamber 67, typically (but not necessarily) near the bottom or entrance to catalytic combustor 35, and a second opening near the top or exit of catalytic combustor 35.

The alternative multiple combustor and bypass structure illustrated in FIGS. 7 and 8 functions as described above to achieve the same objects as the combustor and bypass structures illustrated in FIG. 1–5.

Operation of a catalytic combustor in a wood burning stove is typically best achieved by provision of a secondary air supply for the supply of oxygen to support combustion of smoke and other products of combustion within and in the vicinity of the catalytic combustor. Thus a means for supplying secondary air is provided in stove 1 by provision of secondary air tube 15 and secondary air opening 56 which supply air to the combustion chamber 67 near the underside of combustor 35, as may be appreciated by reference to FIGS. 1, 2 and 3. Control of secondary air is achieved by variable obstruction of secondary air opening 56 by secondary air adjustment slide 57.

An alternative secondary air supply structure is shown in FIGS. 5 and 6. In the alternative embodiment, secondary air tube 60 registers with secondary air opening 56 and is disposed at its upper end partially within a larger tube 61 open on both ends to the firebox 10. During stove operation, secondary air flows from the exterior of the firebox 10 through secondary air opening 56, through tubes 60 and 61 and into the combustion chamber 67 near the lower side of combustor 35 as described above. Additionally, air and gaseous combustion products in combustion chamber 67 are drawn into the lower end of secondary air tube second section 61 as indicated by arrow 68 in FIG. 5. Such hot air and gaseous products of combustion mix with the secondary air within air tube second section 61, thereby preheating the secondary air before it exits near the underside of combustor 35. Such preheating contributes to improved combustor operation.

Although the present invention is described and illustrated above with detailed reference to the preferred embodiments, the invention is not intented to be limited to the details of such embodiments but includes numerous modifications and changes thereto while still falling within the intent and spirit hereof.

I claim:

1. A stove comprising:

(a) a firebox forming a combustion chamber;

(b) a second chamber having an opening for connection to a flue and communicating with the combustion chamber;

(c) a catalytic combustor mounted in a sleeve communicating between the combustion chamber and the second chamber;

(d) a bypass communicating between regions in the combustion chamber and the second chamber immediately below and above the catalytic combustor;

(e) a means for supplying primary air to the combustion chamber; and (f) a means for supplying secondary air to the combustion chamber near the catalytic combustor, comprising a first tube and a second tube, the first tube communicating between the exterior of the firebox and the combustion chamber within the second tube, the second tube being substantially vertical and open to the combustion chamber at the top and bottom ends thereof, the top end being near the catalytic combustor.

2. A stove comprising:

(a) a firebox forming a combustion chamber;

(b) a second chamber having an opening for connection to a flue and communicating with the combustion chamber;

(c) a catalytic combustor mounted in a sleeve communicating between the combustion chamber and the second chamber;

(d) a bypass communicating between regions in the combustion chamber and the second chamber immediately below and above the catalytic combustor; and (e) a turret mounted on the stove having an opening covered by a sight glass disposed above and in registration with the catalytic combustor and spaced apart from the second chamber.

3. A stove comprising:

(a) a firebox forming a combustion chamber and having first and second openings to the exterior of the firebox;

(b) a second chamber having an opening for connection to a flue and communicating with the combustion chamber through:

(i) a smoke relief opening located proximate to the first opening;

(ii) a sleeve; and (iii) a bypass communicating with regions at each end of the sleeve;

(c) A monolithic ceramic substrate catalytic combustor mounted in a sleeve;

(d) a loading door on the firebox moveable between open and closed positions relative to the first opening in the firebox and having openings to provide a primary supply of air to the combustion chamber;

(e) a smoke relief door coupled to the loading door for closing the smoke relief opening when the loading door is closed;

(f) a means for supplying secondary air to the combustion chamber near the catalytic combustor, comprising a first tube and a second tube, the first tube communicating between the exterior of the firebox and the combustion chamber within the second tube, the second tube being substantially vertical and open to the combustion chamber at the top and bottom ends thereof, the top end being near the catalytic combustor; and (g) a turret mounted on the stove having an opening covered by a sight glass disposed above and in registration with the catalytic combustor and spaced apart from the second chamber.

* * * * *